United States Patent [19]

Jaqua

[11] Patent Number: 4,799,827

[45] Date of Patent: Jan. 24, 1989

[54] MODULAR RISER TENSIONER INCORPORATING INTEGRAL HYDRAULIC CYLINDER ACCUMULATOR UNITS

[75] Inventor: David L. Jaqua, Oak View, Calif.

[73] Assignee: Vetco Gray Inc., Houston, Tex.

[21] Appl. No.: 931,321

[22] Filed: Nov. 17, 1986

[51] Int. Cl.[4] ..... E02D 21/00

[52] U.S. Cl. ..... 405/195; 166/350; 166/355; 405/303; 267/126; 254/277

[58] Field of Search ..... 405/195, 224; 175/5–7; 166/350, 355, 359, 367; 114/264, 265, 256; 267/124–126; 254/277, 900

[56] References Cited

U.S. PATENT DOCUMENTS

| | | | |
|---|---|---|---|
| 3,580,559 | 5/1971 | Spieth | 267/126 |
| 3,912,227 | 10/1975 | Meeker et al. | 175/5 X |
| 3,943,868 | 3/1976 | Person et al. | 114/264 |
| 4,222,341 | 9/1980 | Larsen et al. | 175/5 X |
| 4,379,657 | 4/1983 | Widiner et al. | 405/195 |
| 4,423,983 | 1/1984 | Dadiras et al. | 405/195 |
| 4,449,854 | 5/1984 | Nayler | 175/7 X |
| 4,540,159 | 9/1985 | Jordan | 254/277 X |

OTHER PUBLICATIONS

The Retsco Space Saver TM Riser Tensioner, Retsco, Inc. 1985.

*Primary Examiner*—Dennis L. Taylor
*Attorney, Agent, or Firm*—Joseph R. Dwyer

[57] ABSTRACT

A tensioner unit (12) comprising an inner cylinder (22), filled partially with hydraulic fluid, with a piston (26) and piston rod (28) reciprocal therein (sometimes referred to as a hydraulic cylinder) surrounded by a cylindrical chamber (40) (sometimes referred to as an accumulator) for hydraulic fluid and gas. The gas in accumulator (40) is pressurized to maintain the hydraulic fluid under pressure against the piston (26) placing the piston rod (28) under tension to provide the necessary tension force on a marine riser (14) and to compensate for the rise and fall of a floating platform. This is a self-contained integral unit with one end of the piston rod (28) connected to the riser (14), and the other end connected to a frame (16) supported on a platform of a TLP. A plurality of such tensioner units (12) on this frame (16) and connected to said riser (14) form a complete riser tensioner (10) without external accumulators.

4 Claims, 3 Drawing Sheets

MODULAR RISER TENSIONER INCORPORATING INTEGRAL HYDRAULIC CYLINDER ACCUMULATOR UNITS

BACKGROUND OF THE INVENTION

1. Field of INVENTION

This invention relates to offshore oil and gas drilling and production and, in particular, to apparatus for tensioning marine risers to a floating platform. This invention will be described in connection with production marine risers and tensioned leg floating platforms (TLP), but it is to be understood that this invention may be used with any floating platform and any marine riser, such as a drilling riser.

2. Prior Art

In the production of oil to a tensioned leg floating platform, a conductor or riser has its lower end secured to a connection at the seabed, and its upper end terminated at the platform. Conventionally, this riser is supported by a tensioning force applied to the upper end of the riser.

Because of the relative motion between the platform and the seabed caused by wave and tide actions, some device is required to maintain the tension on the riser while permitting this relative motion.

One such device is described in the U.S. Pat. No. 4,379,657 to Widiner et al. This patent disclosed a modular riser tensioner made up of a plurality of hydraulic cylinders connected to external oil and gas accumulators mounted on a frame to develop the tension force on the riser. This device did not use wire ropes and thus eliminated the problems of wire rope maintenance and breakage.

Another tensioner was disclosed in the U.S. Pat. No. 4,367,981, to Shapiro. In this patent, the riser tensioner was formed within a slip joint and supplied with hydraulic fluid pressure to develop the tension force by external accumulators as did the Widiner et al device.

Still another hydropneumatic riser tensioner is disclosed in the U.S. Pat. No. 4,540,159 to Jordan which did not require connection between the hydraulic cylinders and external gas or oil accumulators to develop the tension force. This device was used as a cable tensioner and had the same problem of wire rope maintenance and breakage as in the prior art. Although this device was self-contained, it also had multiple cylinders; one which contained a supply of compressed gas (a first accumulator), a second or middle chamber which contained hydraulic fluid, (a second accumulator) pressurized by the gas from the gas accumulator and a central chamber (hydraulic cylinder) which housed the piston and piston rod. This device is intended to be permanently mounted in a deck location, built into a rig support structure, with individual control lines.

Accordingly, it is an object of this invention to improve the prior art riser tensioners by providing a single self-contained air and hydraulic fluid accumulator and hydraulic cylinder which is integrated into a modular tensioner unit. An assembly of such tensioning units forms a riser tensioner.

It will also be apparent to those skilled in the art that by having a one piece accumulator/hydraulic cylinder tensioner unit; much of the existing piping can be removed,making the riser tensioner safer and easier to install; that the unit is of reduced size and weight; and that the complete tensioner-unit may be installed or removed with only the connection/disconnection of the control lines.

SUMMARY OF THE INVENTION

The tensioner unit which meets the foregoing object comprises an inner cylinder with a piston and rod reciprocal therein (hydraulic cylinder) surrounded by a cylindrical chamber (accumulator) for hydraulic fluid and gas. The gas in this accumulator is pressurized to maintain the hydraulic fluid under pressure against the piston and rod to provide the necessary tension force and to compensate for the rise and fall of the floating platform. This is a self-contained integral unit with one end of the piston rod connected to the riser and the other end of the tensioner unit connected to a frame supported on the platform of a TLP. A plurality (four shown) of such tensioner units on this frame form a complete riser tensioner without external accumulators.

DETAILED DESCRIPTION

Figure 1:
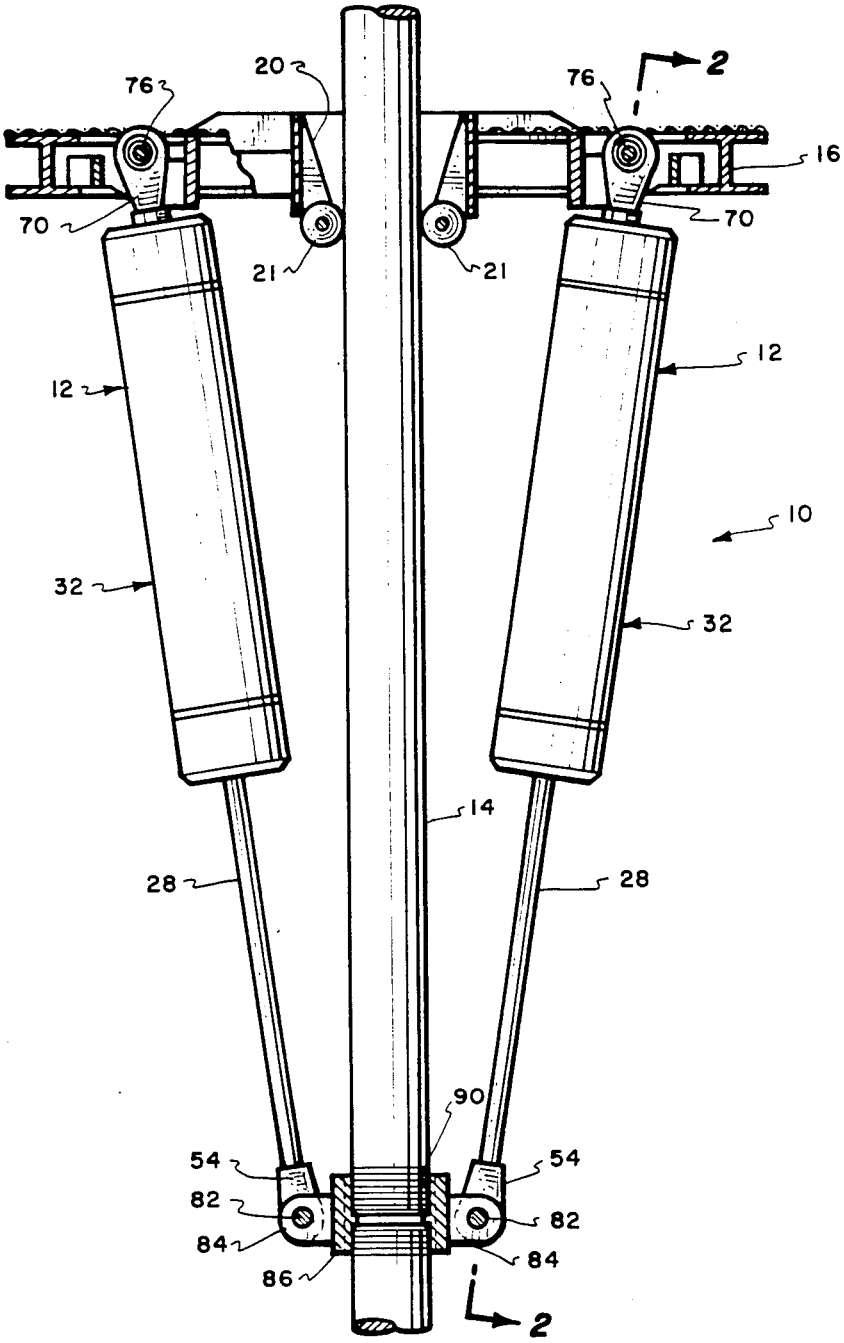
FIG. 1 is an elevational view showing two tensioner units forming part of the riser tensioner.

As shown in FIG. 1, the riser tensioner 10 of this invention includes a plurality of tensioner units 12 which are each pivotally connected at their lower ends to a riser 14 to be tensioned and at their upper ends to a frame 16.

Figure 3:
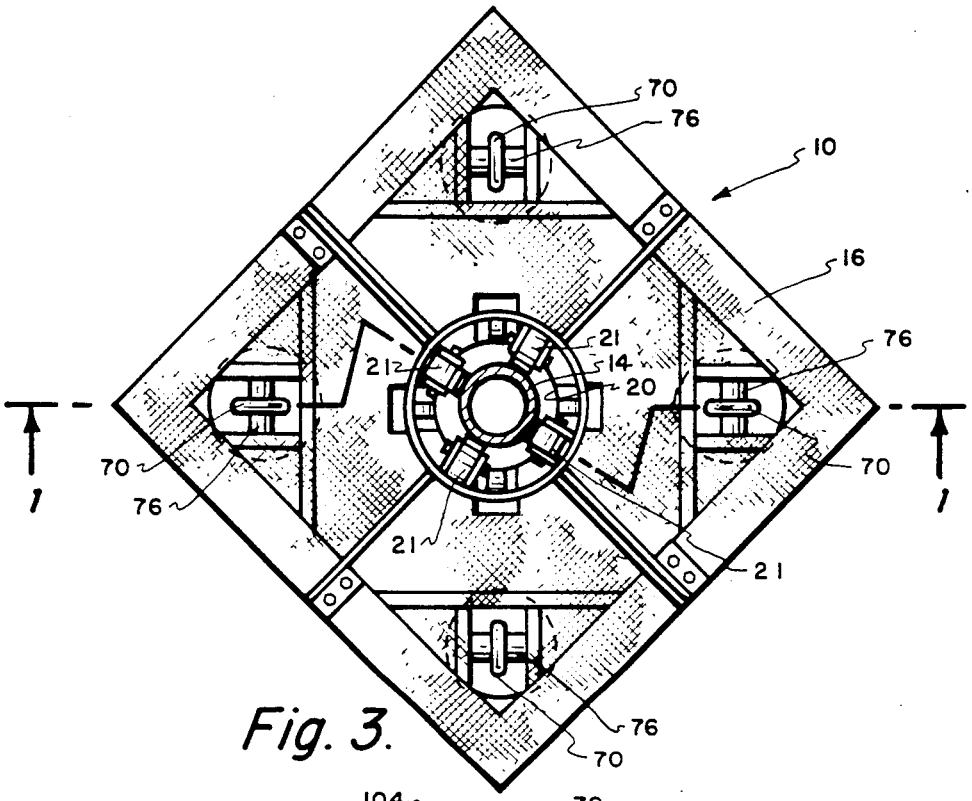
FIG. 3 is a plan view of a frame of the riser tensioner showing four tensioner units and the orientation of the units with respect to FIG. 1.

As shown in FIG. 3, the frame 16 has a central opening 20 in which the riser is located. Centralizing roller assemblies 21 operate to maintain the riser centrally within the opening 20. A tensioned leg platform (not shown) has a square opening (also not shown) in its deck where the riser tensioner 10 and its frame 16 are supported.

Figure 2:
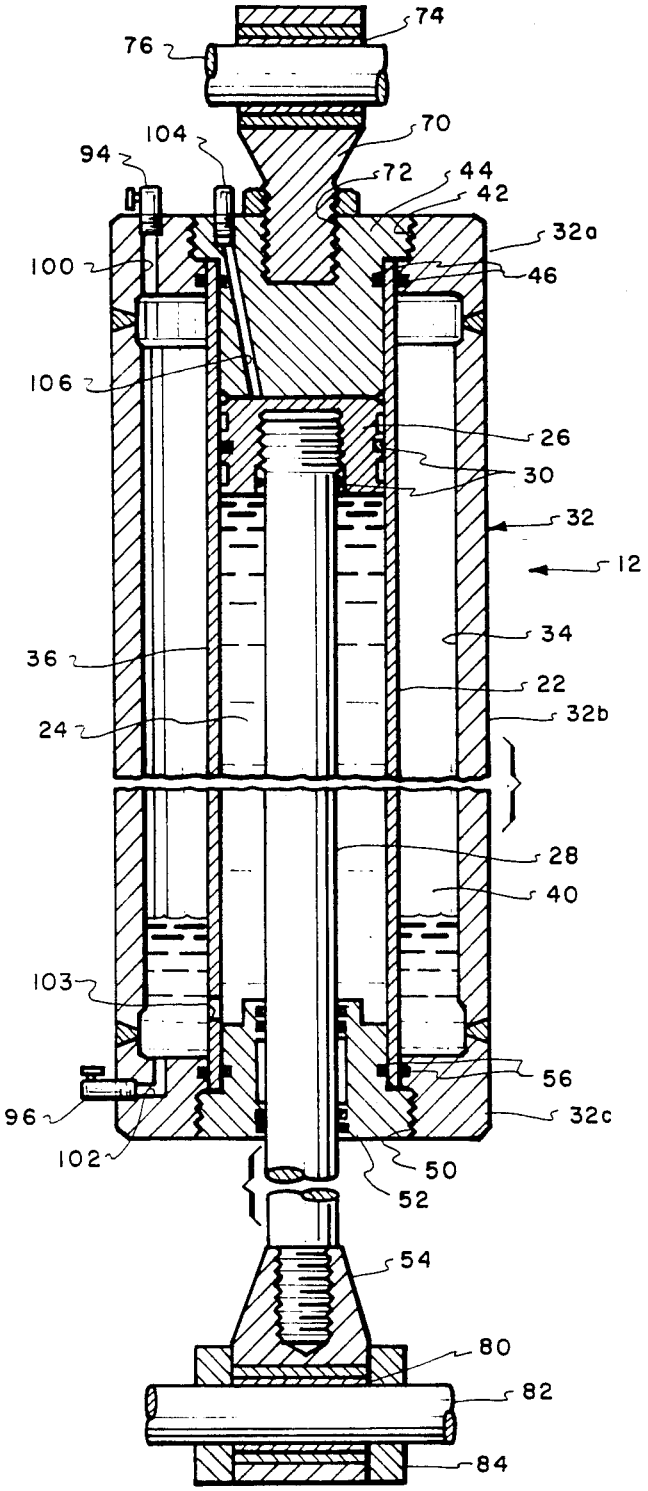
FIG. 2 is an elevational cross-sectional view of one of tensioner unit, taken along line 2—2 of FIG. 1.

Turning now specifically to FIG. 2, where one of the tensioner units 12 is shown in cross-section, it can be seen that each tensioner unit 12 comprises an inner hydraulic cylinder 22 extending substantially the entire length of the tensioner unit 12 forming a chamber 24 and containing a piston 26 and a piston rod 28 for reciprocation therein. Suitable seals 30 are provided, where necessary, to prevent leakage.

This hydraulic cylinder 22 is surrounded by an outer cylinder 32, whose inner wall 34 is spaced from the outer wall 36 of the hydraulic cylinder 22, and which forms another chamber (accumulator) 40. This outer cylinder 32 comprises three parts 32*a*, 32*b*, and 32*c*, welded together to form a closed tensioner unit. The top part 32*a* is bored and threaded as at 42 to contain a threaded blind head 44 which telescopes within the hydraulic cylinder 22 to close the top end thereof. Suitable seals 46 are provided, where necessary, to prevent leakage.

The lower part 32*c* is also bored and threaded as at 50, like the upper part 32*a*, to contain a threaded rod head 52 which telescopes within the hydraulic cylinder 22. The piston rod 28 extends out through the rod head 52 where the end of the piston rod 28 is connected to a rod end 54 in a suitable manner, as by threading. Again, suitable seals 56 are provided, where necessary, to prevent leakage.

To pivotally connect the upper end of the tensioner unit 12 to the frame 16, a spherical rod end 70 is threaded into a threaded blind bore 72 in the upper part 32*a*. This spherical rod end 70 is provided with a bore and suitable bearings 74 where a shaft 76 is suitably connected to the frame 16.

To pivotally connect the lower end of the tensioner unit 12 to the riser 14, the piston rod end 54 is provided with a bore and suitable bearings 80 for a pin 82 which engages a eye element 84. The latter is part of a tensioning ring 86 which is in threaded engagement with the riser 14 as at 90. See FIG. 1.

As mentioned, a plurality of these tensioner units 12, connected to the frame 16 and to the riser 14, form the riser tensioner 10. Two such units are shown in FIG. 1 and the position of four such units are shown in the plan view of the frame 16 in FIG. 3.

To prepare each tensioner unit 12 for operation, needle valves 94 and 96, which are threaded into fluid charge ports 100 and 102, respectively, are opened and the piston rod 28 is fully extended. A predetermined amount of hydraulic fluid is pumped into the accumulator 40 and to the chamber 24 through opening 103 to give the tensioner unit the desired spring constant after which time the needle valve 94 is closed. Thereafter, nitrogen under pressure is introduced through port 100 until a predetermined charge pressure is reached. During this nitrogen charging, the piston rod 28 will retract until the piston 26 comes into contact with cylinder head 44. Check or breather one-way valve 104 threaded into passage 106 allows any air or gas in the chamber 24 between the top of the piston 26 and the cylinder head 44 to escape. This valve 104 also controls the vacuum formed in the chamber 24 during operation—see FIG. 4. After the nitrogen has reached the desired pressure,- needle valve 94 is closed.

Figure 4:
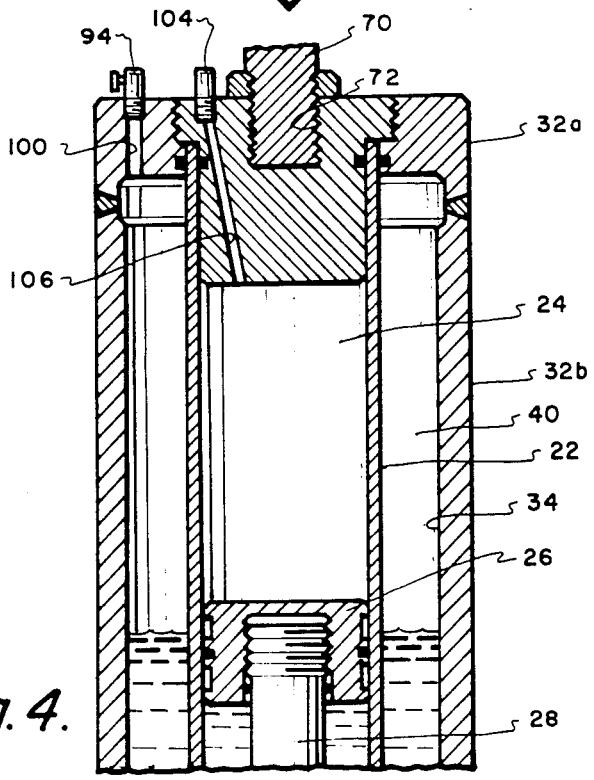
FIG. 4 is a partial cross-sectional elevational view showing the piston and rod spaced from the position shown in FIG. 2 as an example of an operating position of the piston.

In use, the piston 26 will assume a position, somewhat as shown in FIG. 4, with the gas in the accumulator 40 being compressed (acting like a fluid spring) to pressurize the hydraulic fluid against a bottom of the piston 26. The gas under pressure maintains the hydraulic fluid against the rod side of the piston to provide the riser tensioning force on the riser.

I claim:

1. A valveless tensioner unit for supporting a riser from a floating platform including means for supporting said tensioner unit on said platform and means for connecting said tensioner unit to said riser, the improvement comprising, an inner cylinder, a piston and piston rod reciprocal in said inner cylinder, said means for connecting said tensioner unit to said riser being connected to said piston rod, a single outer cylinder surrounding said inner cylinder and forming an accumulator and containing hydraulic fluid and gas under pressure, means continuously communicating said hydraulic fluid under pressure to the rod side of said piston to provide the tensioned force on said riser so that said riser is always under tension, said outer cylinder being otherwise out of fluid communication with said inner cylinder or any other apparatus, the side of said piston opposite said rod free of hydraulic fluid from said accumulator at all times, and means sealing said inner and outer cylinders to provide a self-contained tensioner unit.

2. The tension unit as claimed in claim 1 and further including similar tensioning units acting in combination with said first tensioning unit to provide a riser tensioner.

3. A valveless riser tensioner for supporting a riser from a floating platform comprising, a mounting frame supported from the platform, a riser tensioning ring having means for supporting said riser on said tensioning ring, at least two pairs of hydraulic cylinders, one of each of said pair of hydraulic cylinders being diametrically opposed to the other of said pair, a piston having a rod slideable in each of said hydraulic cylinders, said rod being connected to said tensioning ring, each pair of hydraulic cylinders being surrounded by an accumulator which comprises a single cylinder and containing pressurized gas and hydraulic fluid totally within said single cylinder and in continuous fluid communication with the rod side of said piston whereby said hydraulic fluid in response to said gas under pressure acts on the piston on the rod side of said piston to provide a tension force at all times on said riser, the side of said piston opposite said rod being out of communication with said accumulator and free of hydraulic fluid and gas from said accumulator.

4. The riser tensioner as claimed in claim 3 wherein said tension force on said riser is obtained by placing said rod under tension.

* * * * *